US006666190B1

(12) United States Patent
DiMaria et al.

(10) Patent No.: US 6,666,190 B1
(45) Date of Patent: Dec. 23, 2003

(54) INTEGRATED FUEL DELIVERY AND ELECTRICAL CONNECTION FOR ELECTRONIC FUEL INJECTORS

(75) Inventors: Anthony Frank DiMaria, Dearborn, MI (US); William Francis Gubing, III, Canton, MI (US); David Walter Kunitz, Dexter, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/248,265

(22) Filed: Jan. 3, 2003

(51) Int. Cl.[7] ..... F02M 37/04
(52) U.S. Cl. ..... 123/470; 123/456; 439/76.1
(58) Field of Search ..... 123/470, 472, 123/469, 468, 456; 439/130, 76.1, 79, 80; 251/129, 14

(56) References Cited

U.S. PATENT DOCUMENTS 4,474,160 A 10/1984 Gartner
4,857,003 A 8/1989 Hafner et al.
4,950,171 A * 8/1990 Muzslay ..... 439/76.1
5,263,649 A 11/1993 Babitzka et al.
5,301,647 A 4/1994 Lorraine
5,308,038 A * 5/1994 McArthur ..... 251/129.14
5,323,749 A 6/1994 Gras et al.
5,471,961 A * 12/1995 McArthur et al. ..... 123/456
5,598,824 A 2/1997 Treusch et al.
5,738,284 A 4/1998 Gruendl et al.
5,893,351 A * 4/1999 Akutagawa et al. ..... 123/470
5,934,253 A * 8/1999 Kojima et al. ..... 123/470
6,012,418 A * 1/2000 Bodenhausen et al. ..... 123/470
6,062,200 A * 5/2000 Hofmeister ..... 123/470
6,418,912 B1 7/2002 Lorraine

* cited by examiner

*Primary Examiner*—Carl S. Miller

(57) ABSTRACT

An integrated fuel delivery and electrical connection system including an electrical bus, a fuel delivery tube and a plurality of fuel injectors is provided. The electrical bus may include openings for insertion and connection of fuel injectors, and positive and ground electrical contacts for electrical connection to respective fuel injector positive and ground contacts. The fuel delivery tube may include corresponding openings for insertion and connection of fuel injectors. A method of installing the above-identified system is also provided and includes the steps of inserting fuel injectors into openings in the electrical bus and fuel delivery tube, and thereafter connecting a single electrical harness to the electrical bus to provide electricity to the system. The electrical bus may be used in a standalone configuration, may be integrated with the fuel delivery tube, or may be packaged with fuel injectors to form an integrated package for assembly onto an automobile engine.

27 Claims, 3 Drawing Sheets

INTEGRATED FUEL DELIVERY AND ELECTRICAL CONNECTION FOR ELECTRONIC FUEL INJECTORS

BACKGROUND OF INVENTION a. Field of Invention

The invention relates generally to fuel injectors, and, more particularly to an improved apparatus and method for delivering fuel via fuel injectors, and electrically wiring fuel injectors in an internal combustion engine.

b. Description of Related Art

Modern internal combustion engines generally include electronic fuel injectors for delivering fuel into the combustion chamber. Known fuel injector types include, for example, top, bottom and side feed fuel injectors in which fuel is respectively delivered adjacent the top, bottom or side of the fuel injector.

Conventional top feed fuel injectors generally require a bulky electrical connector mounted adjacent to the top of the injector body. These bulky electrical connectors increase assembly complexity and consume valuable space needed for component packaging. During engine repair or manufacturing, conventional electrical connectors can often be difficult to access. Moreover, conventional injector wiring harnesses can be difficult to secure in the compact engine spaces, are often poorly defined due to the lack of adequate spacing, and may themselves unnecessarily consume packaging space.

As engine s become increasingly complex and compact, the space available for mounting fuel injectors, fuel rails, and electrical wiring harnesses becomes increasingly limited.

Various conventional very systems and electrical connectors for fuel injectors are known and disclosed, for example, in U.S. Pat. No. 6,338,333 to Brosseau et al. ( grosseau) and U.S. Pat. No. 6,260,537 to Lamb et al. ( Lamb).

U.S. Pat. No. 6,338,333 to Brosseau discloses an integrated fuel delivery system for fuel injectors in an internal combustion engine. Brosseau however does not address the electrical connections to fuel injectors or the wire harness layout, which factor into the drawbacks of today's conventional fuel injection system designs. U.S. Pat. No. 6,260,537 to Lamb discloses bottom feed fuel injectors with electrical wiring connections on top. As for Brosseau, Lamb also does not simplify electrical connections for fuel injectors so as to facilitate the installation and testing thereof.

For the U.S. Patents cited above, from a design and manufacturing standpoint, the manufacture of the relatively complicated fuel delivery and electrical connection systems of the past has resulted in a noticeable increase in the overall manufacturing cost of vehicles, which are typically manufactured by the hundreds of thousands. From an assembly standpoint, the assembly and installation of complex electrical connectors and wiring harnesses can be time-consuming and burdensome, and can further add to the overall cost of a vehicle. Lastly, from a maintenance and use standpoint, improvements in conventional electrical connectors and fuel delivery systems of today's internal combustion engines would likewise provide improvement in the durability of such engines.

SUMMARY OF INVENTION

The invention solves the problems and overcomes the drawbacks and disadvantages of the prior art fuel injection systems by providing an integrated fuel delivery and electrical connection system for fuel injectors in an internal combustion engine.

Thus, an aspect of the present invention is to provide a fuel delivery system which incorporates the electrical contacts of a conventional electrical connector into the fuel rail assembly.

Another aspect of the present invention is to provide fuel injectors having integral electrical connections for contact with the electrical contacts on the fuel delivery system of the present invention.

Yet another aspect of the present invention is to eliminate or substantially reduce the need for external wire harness routing.

Another aspect of the present invention is to provide a single point wiring harness connection for electrical connection to the fuel injectors.

Yet another aspect of the present invention is to provide a method for testing fuel injection systems before final engine assembly, and simplifying injector installation and removal.

The invention accomplishes these aspects by providing an integrated fuel delivery and electrical connection system generally including an electrical bus, a fuel delivery tube and fuel injectors. The electrical bus may include openings for insertion and connection of fuel injectors. The electrical bus may further include positive electrical contacts for electrical connection to a respective fuel injector positive electrical contact and ground contacts for grounding a fuel injector ground contact. The fuel delivery tube may include openings for insertion and connection of fuel injectors, and may be connected to the electrical bus. A portion of each of the fuel injectors may be inserted into each of the openings in the electrical bus and fuel delivery tube to thereby connect each fuel injector to the electrical bus and fuel delivery tube.

For the fuel delivery and electrical connection system described above, each of the positive electrical contacts in the electrical bus may be mounted at a first radial distance from a central longitudinal axis of the electrical bus and the ground contact in the electrical bus may be mounted at a second radial distance from the central axis. The first radial distance may be less than the second radial distance, greater than the second radial distance, or approximately equal to the second radial distance. The electrical bus may further include an electrical environmental seal for preventing contamination of the positive and ground contacts of the electrical bus and the fuel injector upon connection thereof with the positive and ground contacts on the fuel injector. A plurality of electrical wires may be connected to each of the positive and ground contacts in the electrical bus and terminate at a generally single connection point on the electrical bus. The electrical bus and the fuel delivery tube may be fabricated as a single unit or as separate components of an assembly. The fuel injector positive electrical contact may be mounted at a first axial distance from a fuel injector end surface along a fuel injector central longitudinal axis and the fuel injector ground contact may be mounted at a second axial distance from the fuel injector end surface along the fuel injector central longitudinal axis. The first axial distance may be less than the second axial distance, greater than the second axial distance, or approximately equal to the second axial distance. The fuel injector positive and ground contacts may each be located at a predetermined location along the fuel injector central longitudinal axis and disposed substantially along opposite surfaces of the fuel injector. The fuel injector may further include an electrical environmental seal for preventing contamination of the positive and ground contacts of the electrical bus and the fuel injector upon connection thereof with the fuel injector positive and ground contacts.

The present invention also provides a method of installing an integrated fuel delivery and electrical connection system in an internal combustion engine. The method may include the step of inserting fuel injectors into an opening in an electrical bus. The electrical bus may include positive electrical contacts for electrical connection to fuel injector positive electrical contacts and ground contacts for grounding fuel injector ground contacts. The method may further include the step of connecting the electrical bus and fuel injectors to a fuel delivery tube. The fuel delivery tube may include corresponding openings for insertion and connection of the fuel injectors. The method may yet further include the step of connecting a single electrical harness to the electrical bus to provide electricity to the system.

For the method described above, the method may further include the steps of affixing the positive electrical contact in the electrical bus at a first radial distance from a central longitudinal axis of the electrical bus and affixing the ground contact in the electrical bus at a second radial distance from the central longitudinal axis. The first radial distance may be less than the second radial distance, greater than the second radial distance, or approximately equal to the second radial distance. The method may further include the step of providing an electrical environmental seal in the electrical bus for preventing contamination of the positive and ground contacts of the electrical bus and the fuel injector upon connection thereof with the fuel injector positive and ground contacts. The electrical bus may be made of a non-conductive material such as plastic. The method may further include the steps of connecting electrical wires to each of the positive and ground contacts in the electrical bus. The electrical wires may terminate at a generally single connection point on the electrical bus. The electrical bus and the fuel delivery tube may be fabricated as a single unit or as separate components. The method may further include the steps of affixing the positive electrical contact on the fuel injector at a first axial distance from a fuel injector end surface along a fuel injector central longitudinal axis, and affixing the ground contact on the fuel injector at a second axial distance from the fuel injector end surface along the fuel injector central longitudinal axis. The first axial distance may be less than the second axial distance, greater than the second axial distance, or approximately equal to the second axial distance. The method may further include the step of providing the fuel injector with an electrical environmental seal for preventing contamination of the positive and ground contacts of the electrical bus and the fuel injector upon connection thereof with the fuel injector positive and ground contacts.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation with out limiting the scope of the invention as claimed.

BRIEF DESCRIPTION OF DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION

Figure 1:
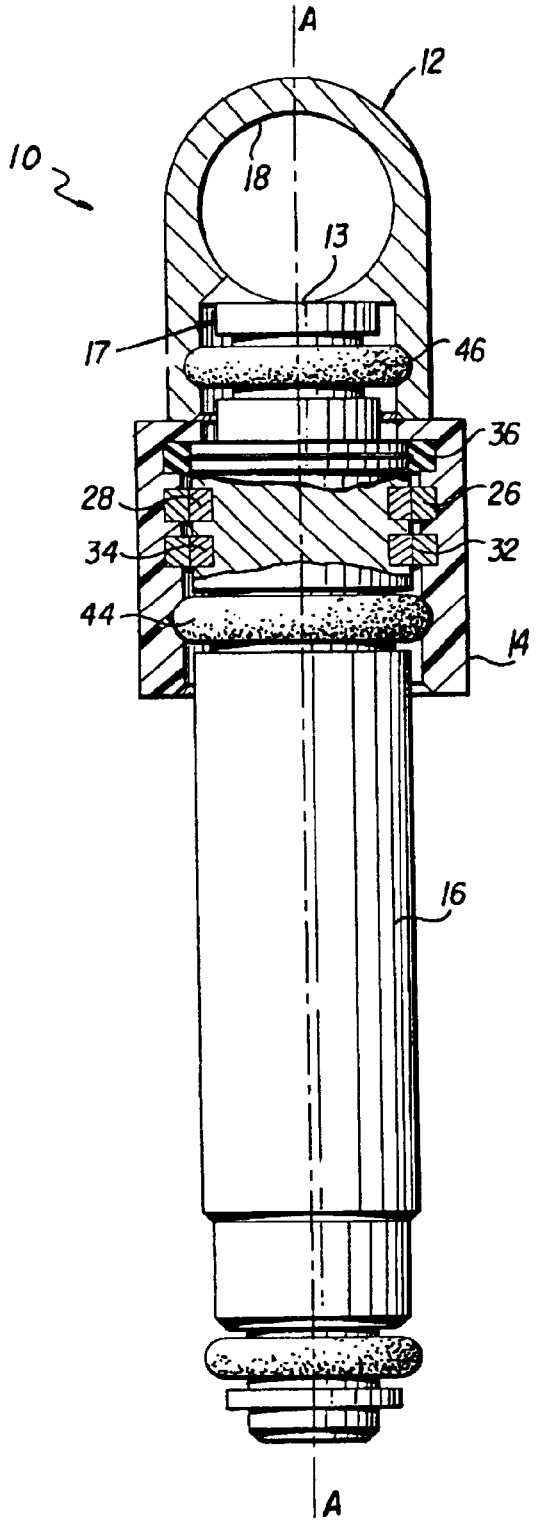
FIG. 1 is an illustrative front view of a fuel injection system according to the present invention, including a first embodiment of a fuel injector for installation to a fuel delivery tube.
Figure 3A:
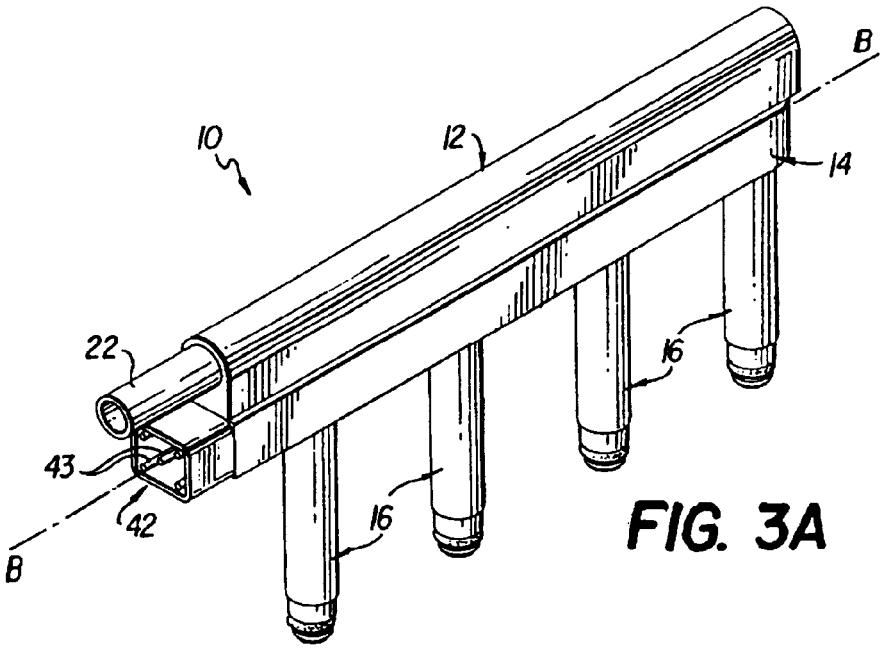
FIG. 3A is an illustrative perspective view of the fuel injection system according to the present invention, illustrating fuel injectors, a fuel delivery tube and an electrical bus in an assembled configuration.
Figure 3B:
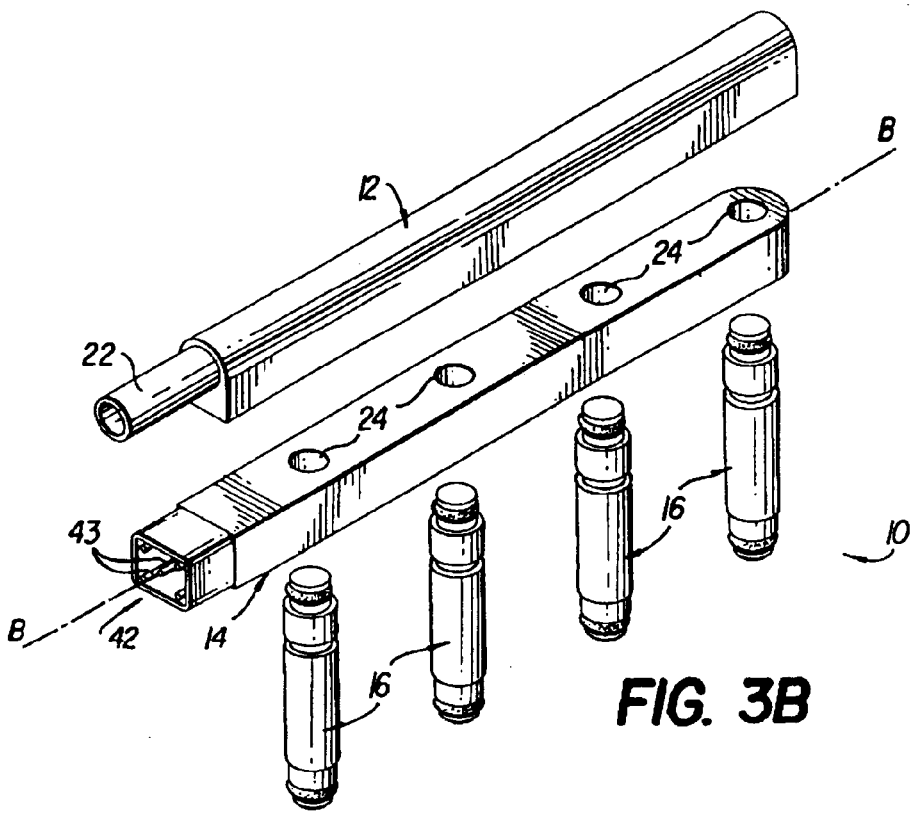
FIG. 3B is an exploded perspective view of the fuel injection system of FIG. 3A, illustrating fuel injectors, the fuel delivery tube and the electrical bus in a disassembled configuration.

Referring now to the drawings wherein like reference numerals designate corresponding parts throughout the several views, FIGS. 1, 3A and 3B illustrate a first embodiment of an integrated fuel delivery and electrical connection system, generally designated fuel injection system 10. Fuel injection system 10 may generally include a fuel delivery tube 12, an electrical bus 14 and a plurality of fuel injectors 16.

Fuel delivery tube 12 may include an opening 18 for insertion of a fuel tube 22. A plurality of circular openings 13 may be provided in fuel delivery tube 12 for insertion of a top portion 17 of fuel injectors 16 therein, as illustrated in FIG. 1. Openings 13 may be dimensioned to provide a resist-fit between fuel injectors 16 and fuel delivery tube 12.

A plurality of openings 24 may likewise be formed in electrical bus 14 for insertion and connection of fuel injectors 16, as also illustrated in FIG. 1. Openings 24 may be dimensioned to provide a resist-fit between fuel injectors 16 and electrical bus 14. Electrical bus 14 may further include a plurality of positive electrical contacts 26 for electrical connection to a respective fuel injector positive electrical contact 28 (described in greater detail below), and a generally single ground contact 32 for electrical connection to a fuel injector ground contact 34 (described in greater detail below). It should be understood that the location of positive and ground contacts 26, 28 and 32, 34 on electrical bus 14 and fuel injectors 16, respectively, may be reversed from the embodiment illustrated in FIG. 1, as would be apparent to a skilled artisan. An upper electrical environmental seal 36 may be provided in electrical bus 14 for preventing contamination of positive and ground contacts 26, 32 in electrical bus 14 upon connection thereof with positive and ground contacts 32, 34 on fuel injector 16.

Figure 4:
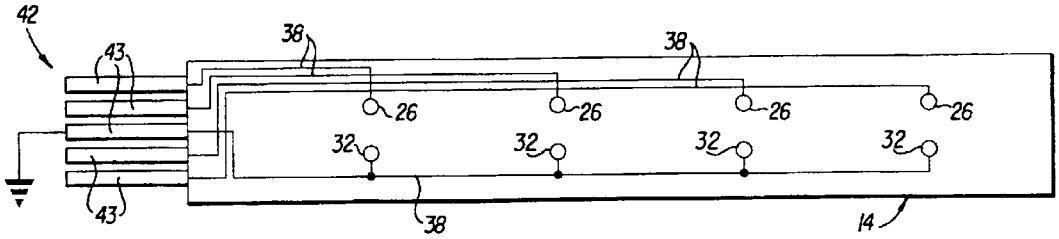
FIG. 4 is an illustrative view of electrical wires which connect the positive and ground contacts in the electrical bus to a generally single connection point.

Referring to FIGS. 3B and 4, a plurality of electrical wires 38 may be connected at one end thereof to respective positive and ground contacts 26, 32 and terminate at a generally single connection point 42 on electrical bus 14. The electrical bus configuration illustrated in FIGS. 3B and 4, includes a plurality of common ground contacts 32 and a plurality of electrical wires 38 leading from ground contacts 32 to connection point 42. Alternatively, it should be understood that a single axially extending ground contact 32 could be employed to achieve the same results. Since the ground connection is common throughout the electrical bus 14, it is apparent that the total number of connection terminals 43 at connection point 42 would be the number of fuel injectors plus one. An electrical supply wire (not shown) having a female connector for insertion of male connection terminals 43 may be connected at connection point 42 to provide electricity for fuel injectors 16. It is apparent that connection point 42 may instead be provided with female connections for insertion of male connections of an electrical supply wire.

Electrical bus 14 may include a plurality of conventional connectors (not shown), such as conventional male/female connectors, for connection thereof to fuel delivery tube 12. Alternatively, since electrical bus 14 is disposed between fuel injector 16 and fuel delivery tube 12, electrical bus 14 may be connected with fuel delivery tube 12 by means of the connection of fuel injectors 16 to fuel delivery tube 12. Electrical bus 14 may be fabricated from a conventional non-conductive material such as plastic or the like.

Referring next to FIG. 1, fuel injector positive and ground contacts 28 and 34, respectively, may be spatially disposed along a fuel injector central longitudinal axis-A to prevent an electrical short therebetween. Likewise positive and ground contacts 26 and 32 may be disposed at predetermined radial locations from a central longitudinal axis-B of electrical bus 14. A lower electrical environmental seal 44 may be provided on fuel injector 16 for preventing contamination of positive and ground contacts 26, 28 in electrical bus 14 upon connection thereof with positive and ground contacts 28, 34 on fuel injector 16. A fuel seal o-ring 46 may also be provided adjacent an upper surface of fuel injector 16 for sealing the contact between fuel injector 16 and fuel delivery tube 12.

Figure 2:
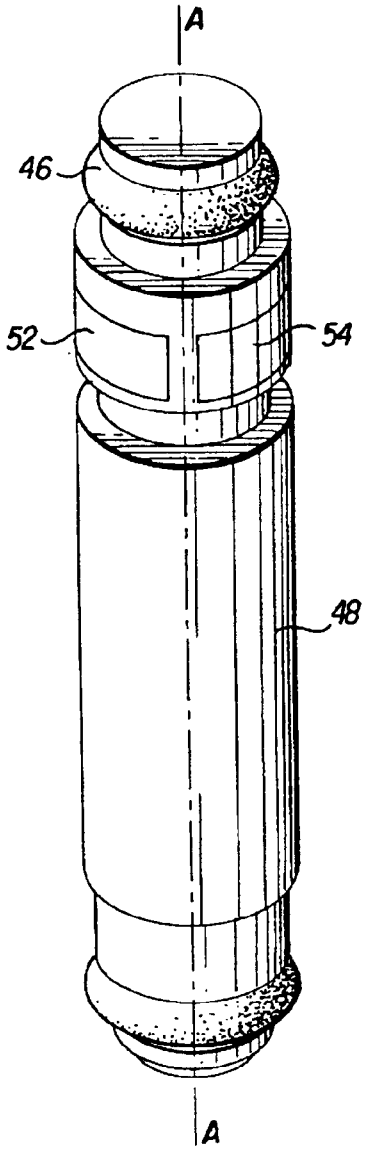
FIG. 2 is an illustrative perspective view of a second embodiment of the fuel injection system according to the present invention.

Referring next to FIG. 2, a second embodiment of a fuel injector 48 according to the present invention is illustrated. For the embodiment of FIG. 2, instead of the positive and ground contacts 28, 34 being axially spaced as illustrated in the fuel injector configuration for FIG. 1, positive and ground contacts 52, 54 for the second embodiment are each disposed at a predetermined location along the central longitudinal axis-A of fuel injector 48. Moreover, positive and ground contacts 52, 54 are disposed at opposite surfaces along the circumference of fuel injector 48 at the predetermined axial location. A fuel seal o-ring 46 may also be provided adjacent an upper surface of fuel injector 48 for sealing the contact between fuel injector 48 and fuel delivery tube 12. For the second embodiment of fuel injector 48, it is apparent that the positive contacts 26 in electrical bus 14 could be located adjacent fuel injector positive contacts 52 and the ground contacts 32 could be located adjacent fuel injector ground contact 54.

An exemplary method for installing and testing fuel injection system 10 will now be described in detail.

In order to install fuel injection system 10 onto an automobile engine, first, one or more fuel injectors 16 (or 48) may be inserted into designated openings 24 in electrical bus 14. Electrical bus 14 may then be connected to fuel delivery tube 12 by means of separate connectors (as discussed above) or by insertion of fuel injector 16 (or 48) into the respective openings 13 in fuel delivery tube 12. The fuel injection system 10 including fuel delivery tube 12, electrical bus 14 and fuel injectors 16 (or 48) may then be mounted onto an engine as necessary. Lastly, as discussed above, an electrical supply wire (not shown) having a female connector may be connected at connection point 42 to provide electricity for fuel injectors 16 (or 48).

In order to test fuel injection system 10 before installation onto an automobile engine, a fuel supply may be connected to fuel tube 22 and an electrical supply wire (not shown) having a female connector may be connected at connection point 42 to provide electricity for fuel injectors 16 (or 48). The fuel injection system 10 including fuel delivery tube 12, electrical bus 14 and fuel injectors 16 (or 48) may then be tested as necessary before mounting onto an engine.

It is apparent from the above discussion that the components of fuel injection system 10, which generally include fuel delivery tube 12, electrical bus 14 and a plurality of fuel injectors 16, may be used in a variety of combinations. For example, electrical bus 14 may be used in a standalone manner and not integrated into fuel delivery tube 12 (i.e. the embodiment shown in FIG. 3B). Alternatively, electrical bus 14 may be fabricated with fuel delivery tube 12 as a single unit, and fuel injectors 16 (or 48) may be separately installed on the unit and thereafter installed onto an automobile engine. Yet in a further combination, electrical bus 14, fuel delivery tube 12 and fuel injectors 16 (or 48) may be fabricated as separate components of an assembly, and thereafter assembled to form an integrated package for installation onto an automobile engine.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. An integrated fuel delivery and electrical connection system comprising:

an electrical bus including:

at least one opening for insertion and connection of a fuel injector;

at least one positive electrical contact for electrical connection to a respective fuel injector positive electrical contact; and at least one ground contact for grounding at least one fuel injector ground contact, a fuel delivery tube including:

at least one opening for insertion and connection of a fuel injector, and at least one fuel injector, wherein said fuel delivery tube is connectable with said electrical bus, and a portion of said fuel injector is insertable into said opening in said electrical bus and fuel delivery tube to thereby connect said fuel injector to said electrical bus and fuel delivery tube.

2. A system according to claim 1, wherein said positive electrical contact in said electrical bus is mounted at a first radial distance from a central longitudinal axis of said electrical bus and said ground contact in said electrical bus is mounted at a second radial distance from said central longitudinal axis.

3. A system according to claim 2, wherein said first radial distance is less than said second radial distance.

4. A system according to claim 2, wherein said first radial distance is greater than said second radial distance.

5. A system according to claim 2, wherein said first radial distance is approximately equal to said second radial distance.

6. A system according to claim 1, wherein said electrical bus further includes at least one electrical environmental seal for preventing contamination of said positive and ground contacts in said electrical bus upon connection thereof with said fuel injector positive and ground contacts.

7. A system according to claim 1, wherein a body of said electrical bus is made of one of a non-conductive material and plastic.

8. A system according to claim 1, wherein said electrical bus further includes at least one electrical wire connected to each of said positive and ground contacts therein, said electrical wires terminating at a generally single connection point on said electrical bus.

9. A system according to claim 1, wherein said electrical bus and said fuel delivery tube are fabricated as one of a single unit and as separate components of an assembly.

10. A system according to claim 1, wherein said fuel injector positive electrical contact is mounted at a first axial distance from a fuel injector end surface along a fuel injector central longitudinal axis and said fuel injector ground contact is mounted at a second axial distance from the fuel injector end surface along said fuel injector central longitudinal axis.

11. A system according to claim 10, wherein said first radial distance is less than said second radial distance.

12. A system according to claim 10, wherein said first radial distance is greater than said second radial distance.

13. A system according to claim 10, wherein said first radial distance is approximately equal to said second radial distance.

14. A system according to claim 1, wherein said fuel injector positive and ground contacts are each located at a predetermined location along a fuel injector central longitudinal axis and disposed substantially along opposite surfaces of said fuel injector along said fuel injector central longitudinal axis.

15. A system according to claim 1, wherein said fuel injector further includes at least one electrical environmental seal for preventing contamination of said positive and ground contacts in said electrical bus upon connection thereof with said fuel injector positive and ground contacts.

16. A method of installing an integrated fuel delivery and electrical connection system in an internal combustion engine, said method comprising:

inserting at least one fuel injector into an opening in an electrical bus, said electrical bus including at least one positive electrical contact for electrical connection to a fuel injector positive electrical contact and at least one ground contact for grounding a fuel injector ground contact;

connecting said electrical bus and said fuel injector to a fuel delivery tube, said fuel delivery tube including at least one opening for insertion and connection of said fuel injector;

connecting a single electrical harness to said electrical bus to provide electricity to said fuel injection system;

affixing said positive electrical contact in said electrical bus at a first radial distance from a central longitudinal axis of said electrical bus; and affixing said ground contact in said electrical bus at a second radial distance from said central longitudinal axis.

17. A method according to claim 16, wherein said first radial distance is less than said second radial distance.

18. A method according to claim 16, wherein said first radial distance is greater than said second radial distance.

19. A method according to claim 16, wherein said first radial distance is approximately equal to said second radial distance.

20. A method according to claim 16, wherein a body of said electrical bus is made of one of a non-conductive material and plastic.

21. A method according to claim 16, further including:

connecting electrical wires to each of said positive and ground contacts in said electrical bus, said electrical wires terminating in a generally single connection point on said electrical bus.

22. A method according to claim 16, further including:

fabricating said electrical bus and said fuel delivery tube as one of a single unit and as separate components of an assembly.

23. A method of installing an integrated fuel delivery and electrical connection system in an internal combustion engine, said method comprising:

inserting at least one fuel injector into an opening in an electrical bus, said electrical bus including at least one positive electrical contact for electrical connection to a fuel injector positive electrical contact and at least one ground contact for grounding a fuel injector ground contact;

connecting said electrical bus and said fuel injector to a fuel delivery tube, said fuel delivery tube including at least one opening for insertion and connection of said fuel injector;

connecting a single electrical harness to said electrical bus to provide electricity to said fuel injection system;

affixing said fuel injector positive electrical contact at a first axial distance from a fuel injector end surface along a fuel injector central longitudinal axis; and affixing said fuel injector ground contact at a second axial distance from the fuel injector end surface along said fuel injector central longitudinal axis.

24. A method according to claim 23, wherein said first radial distance is less than said second radial distance.

25. A method according to claim 23, wherein said first radial distance is greater than said second radial distance.

26. A method according to claim 23, wherein said first radial distance is approximately equal to said second radial distance.

27. A method according to claim 16, further including:

affixing said fuel injector positive and ground contacts at a predetermined location along a fuel injector central longitudinal axis, substantially along opposite surfaces of said fuel injector with respect to said fuel injector central longitudinal axis.

* * * * *